US011131268B2

(12) United States Patent
Kasajima et al.

(10) Patent No.: US 11,131,268 B2
(45) Date of Patent: Sep. 28, 2021

(54) MULTI-CYLINDER INTERNAL COMBUSTION ENGINE

(71) Applicant: Honda Motor Co., Ltd., Tokyo (JP)

(72) Inventors: Yuya Kasajima, Saitama (JP); Yoshihiro Yamaguchi, Saitama (JP); Junji Nagao, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/105,535

(22) Filed: Nov. 26, 2020

(65) Prior Publication Data

US 2021/0156333 A1 May 27, 2021

(30) Foreign Application Priority Data

Nov. 27, 2019 (JP) ..... JP2019-214578

(51) Int. Cl.
*F02F 1/24* (2006.01)

(52) U.S. Cl.
CPC ..... *F02F 1/24* (2013.01)

(58) Field of Classification Search
CPC .. F02F 1/24; F02F 1/4264; F02F 1/243; F02F 2001/4278; F01N 13/10
See application file for complete search history.

(56) References Cited

U.S. PATENT DOCUMENTS 8,146,543 B2 * 4/2012 Kuhlbach ..... F02F 1/243 123/41.82 R
8,256,402 B2 * 9/2012 Yamagata ..... F02D 9/04 123/559.1
9,574,522 B2 * 2/2017 Moran ..... F02F 1/40
2010/0126153 A1 * 5/2010 Nagafuchi ..... F02F 1/4264 60/299
2012/0006287 A1 * 1/2012 Hayman ..... F01L 1/053 123/41.79

(Continued)

FOREIGN PATENT DOCUMENTS

JP 2000205042 7/2000
JP 2008309158 12/2008

(Continued)

OTHER PUBLICATIONS

Office Action of Japan Counterpart Application, with English translation thereof, dated Jun. 2, 2021, pp. 1-4.

*Primary Examiner* — Joseph J Dallo
*Assistant Examiner* — Kurt Philip Liethen
(74) *Attorney, Agent, or Firm* — JCIPRNET

(57) ABSTRACT

The disclosure provides a multi-cylinder internal combustion engine having a cylinder head that includes an exhaust port capable of cooling exhaust gas more effectively. The cylinder head includes: a first ceiling surface that closes a first cylinder having a cylinder axis separated from an exhaust opening by a first distance; a second ceiling surface that closes a second cylinder having a cylinder axis separated from the exhaust opening by a second distance shorter than the first distance; and an exhaust port that extends toward the exhaust opening from two port openings which are open to a combustion chamber for each individual cylinder. The exhaust port individually extends from each of the port openings and merges with each cylinder outside a joining surface of the cylinder head for a cylinder block in a plan view.

4 Claims, 5 Drawing Sheets

(56) References Cited

U.S. PATENT DOCUMENTS

| | | | | |
|---|---|---|---|---|
| 2013/0098000 | A1* | 4/2013 | Ruhland | F02D 13/0246 60/273 |
| 2015/0308369 | A1* | 10/2015 | Kodama | F02F 1/4264 123/193.5 |
| 2016/0298471 | A1* | 10/2016 | Uhlenhake | F02B 33/40 |

FOREIGN PATENT DOCUMENTS

| | | |
|---|---|---|
| JP | 2011157827 | 8/2011 |
| JP | 2014145284 | 8/2014 |

* cited by examiner

MULTI-CYLINDER INTERNAL COMBUSTION ENGINE

CROSS-REFERENCE TO RELATED APPLICATION

This application claims the priority benefits of Japanese application no. 2019-214578, filed on Nov. 27, 2019. The entirety of the above-mentioned patent application is hereby incorporated by reference herein and made a part of this specification.

BACKGROUND

Technical Field

The disclosure relates to a cylinder head including a first ceiling surface, a second ceiling surface, and an exhaust port. The first ceiling surface closes a first cylinder having a cylinder axis separated from an exhaust opening by a first distance. The second ceiling surface closes a second cylinder having a cylinder axis separated from the exhaust opening by a second distance that is shorter than the first distance. The exhaust port extends toward the exhaust opening from two port openings that are open to a combustion chamber for the individual cylinders.

Description of Related Art

For a multi-cylinder internal combustion engine, it is a common form to form multiple intake ports and exhaust ports inside a cylinder head and respectively join an intake manifold for distributing intake air and an exhaust manifold for merging exhaust gas to the intake-side side surface and the exhaust-side side surface of the cylinder head. In recent years, there is also known a form in which an exhaust collecting part for merging exhaust gas is formed inside the cylinder head, and a single exhaust pipe is joined to the exhaust opening on the exhaust-side side surface of the cylinder head.

Since the multi-cylinder internal combustion engine with the exhaust collecting part formed in the cylinder head does not need a separately provided exhaust manifold, besides that the entire internal combustion engine can be miniaturized, the amount of heat released from the exhaust gas can be suppressed, and the temperature of the exhaust gas purification device can be raised at an early stage during warm-up to activate the catalyst. However, it is necessary to properly cool the exhaust gas in order to prevent thermal deterioration of the catalyst due to an excessive temperature rise.

As a cooling structure for such a multi-cylinder internal combustion engine, Patent Document 1 discloses a cylinder head of a multi-cylinder internal combustion engine in which four cylinder bores are arranged in series in the axial direction of the crankshaft. The cylinder head is formed with a first ceiling surface that closes the two cylinder bores on the inner side, and a second ceiling surface that closes the two cylinder bores on the outer side. Two port openings that are open to the combustion chamber are formed on each of the first ceiling surface and the second ceiling surface. The exhaust ports extend from the individual port openings toward a single exhaust opening.

RELATED ART

Patent Document

[Patent Document 1] Japanese Laid-Open No. 2008-309158

The cylinder head is formed with a joining surface that is liquid-tightly stacked on the cylinder block around each of the first ceiling surface and the second ceiling surface. On the joining surface, a wall thickness for forming water jackets around the first ceiling surface and the second ceiling surface is required. In Patent Document 1, two exhaust ports extending from the port openings merge with each other at a position relatively close to the combustion chamber. The exhaust port for each port opening is short. Therefore, the surface area of the exhaust port in contact with the exhaust gas is not large. The cooling effect is not as great as expected. Moreover, the exhaust temperature of the exhaust ports connected to the two cylinder bores on the inner side and the exhaust temperature of the exhaust ports connected to the two cylinder bores on the outer side may vary. As a result, the exhaust gas cannot be cooled properly, and the thermal deterioration of the catalyst due to an excessive temperature rise cannot be prevented.

SUMMARY

According to an embodiment of the disclosure, a multi-cylinder internal combustion engine is provided, including a cylinder head which includes: a first ceiling surface that closes a first cylinder having a cylinder axis separated from an exhaust opening by a first distance; a second ceiling surface that closes a second cylinder having a cylinder axis separated from the exhaust opening by a second distance shorter than the first distance; and an exhaust port that extends toward the exhaust opening from two port openings which are open to a combustion chamber for each individual cylinder. The exhaust port individually extends from each of the port openings and merges with each cylinder outside a joining surface of the cylinder head for a cylinder block in a plan view.

DESCRIPTION OF THE EMBODIMENTS

Figure 1:
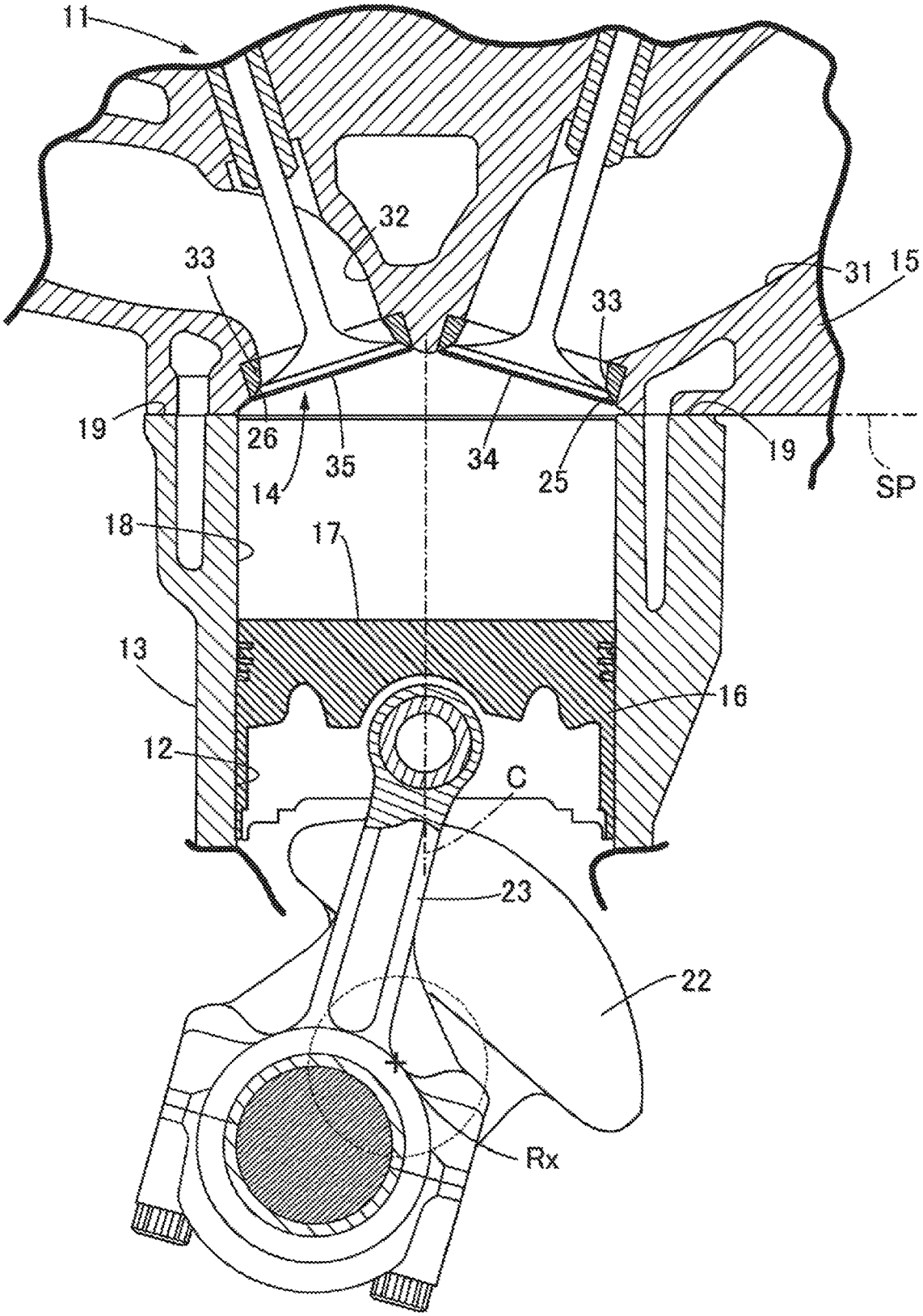
FIG. 1 is a partial cross-sectional view of a multi-cylinder internal combustion engine according to an embodiment of the disclosure, and is a view schematically showing a structure of a cross section including axial centers of an intake valve and an exhaust valve.

In view of the above circumstances, the disclosure provides a cylinder head including an exhaust port capable of cooling the exhaust gas more effectively.

According to an embodiment, in addition to the above configuration, a wall that partitions the two exhaust ports in the second cylinder extends toward an exhaust opening side with respect to a virtual plane that is parallel to a virtual plane including the cylinder axis of the first cylinder and the cylinder axis of the second cylinder and is in contact with a tip of a wall that partitions the two exhaust ports in the first cylinder.

According to an embodiment, in addition to the above configuration, the wall that partitions the two exhaust ports in the second cylinder extends to a virtual plane that is parallel to the virtual plane including the cylinder axis of the first cylinder and the cylinder axis of the second cylinder and is in contact with a tip of a wall that partitions the exhaust port of the first cylinder and the exhaust port of the second cylinder, or extends toward the exhaust opening side with respect to the virtual plane.

According to an embodiment, two exhaust ports for each cylinder extend individually from the combustion chamber. The two exhaust ports for each cylinder merge with each cylinder outside the joining surface of the cylinder head for the cylinder block. The surface area of the exhaust port in contact with the exhaust gas increases. Since heat is transferred from the exhaust gas in the exhaust port to the metal body of the cylinder head, the exhaust gas can be effectively cooled corresponding to the increase of the surface area.

According to an embodiment, in the exhaust port, as the passage length from the port opening to the exhaust opening increases, the surface area in contact with the exhaust gas increases and the cooling effect for the exhaust gas improves. The surface area in contact with the exhaust gas decreases each time the exhaust port merges. The cooling effect is weakened. Since the passage length from the first cylinder to the exhaust opening is longer than the passage length from the second cylinder to the exhaust opening, if the wall that partitions the two exhaust ports in the second cylinder is longer than that of the first cylinder, the cooling effects of the exhaust ports in the first cylinder and the second cylinder can be balanced. The variation in exhaust temperature between the cylinders can be reduced. By converging the exhaust temperature to a specific temperature, thermal deterioration of the catalyst can be prevented. The exhaust gas can be cooled properly.

According to an embodiment, by adjusting the length of the wall that partitions the exhaust port extending from the first cylinder and the exhaust port extending from the second cylinder, the cooling effects of the exhaust ports in the first cylinder and the second cylinder can be balanced. The variation in exhaust temperature between the cylinders can be reduced. By converging the exhaust temperature to a specific temperature, thermal deterioration of the catalyst can be prevented. The exhaust gas can be cooled properly.

Hereinafter, embodiments of the disclosure will be described with reference to the accompanying drawings.

FIG. 1 is a conceptual diagram schematically showing a multi-cylinder internal combustion engine according to an embodiment of the disclosure. The multi-cylinder internal combustion engine 11 includes a cylinder block 13 that has a cylinder bore (cylinder) 12 for partitioning a cylindrical space coaxial with a cylinder axis C, and a cylinder head 15 that is coupled to the upper end of the cylinder block 13 and supports a valve operating mechanism 14. The cylinder block 13 accommodates a piston 16 that is guided by the cylinder bore 12 to reciprocate freely along the cylinder axis C. The piston 16 forms a combustion chamber 18 with the cylinder head 15 with a crown surface 17 facing the cylinder head 15. The opening of the cylinder bore 12 is surrounded by a seat surface 19 that receives the cylinder head 15. The seat surface 19 extends in the plane SP orthogonal to the cylinder axis C. The cylinder block 13 is cast and molded from a metal material such as an aluminum alloy.

A crankshaft 22 that is rotatably supported by a crankcase around a rotation axis Rx is connected to the piston 16. Here, four cylinder bores 12 are arranged in series in the cylinder block 13 in the axial direction of the crankshaft 22 (first cylinder bore, second cylinder bore, third cylinder bore, and fourth cylinder bore in order from one side). A connecting rod 23 connects the piston 16 and the crank pin of the crankshaft 22. The individual pistons 16 are connected to the crankshaft 22 at particular phase angles. The linear motion of the piston 16 is converted into the rotational motion of the crankshaft 22 by the action of the connecting rod 23.

Figure 2:
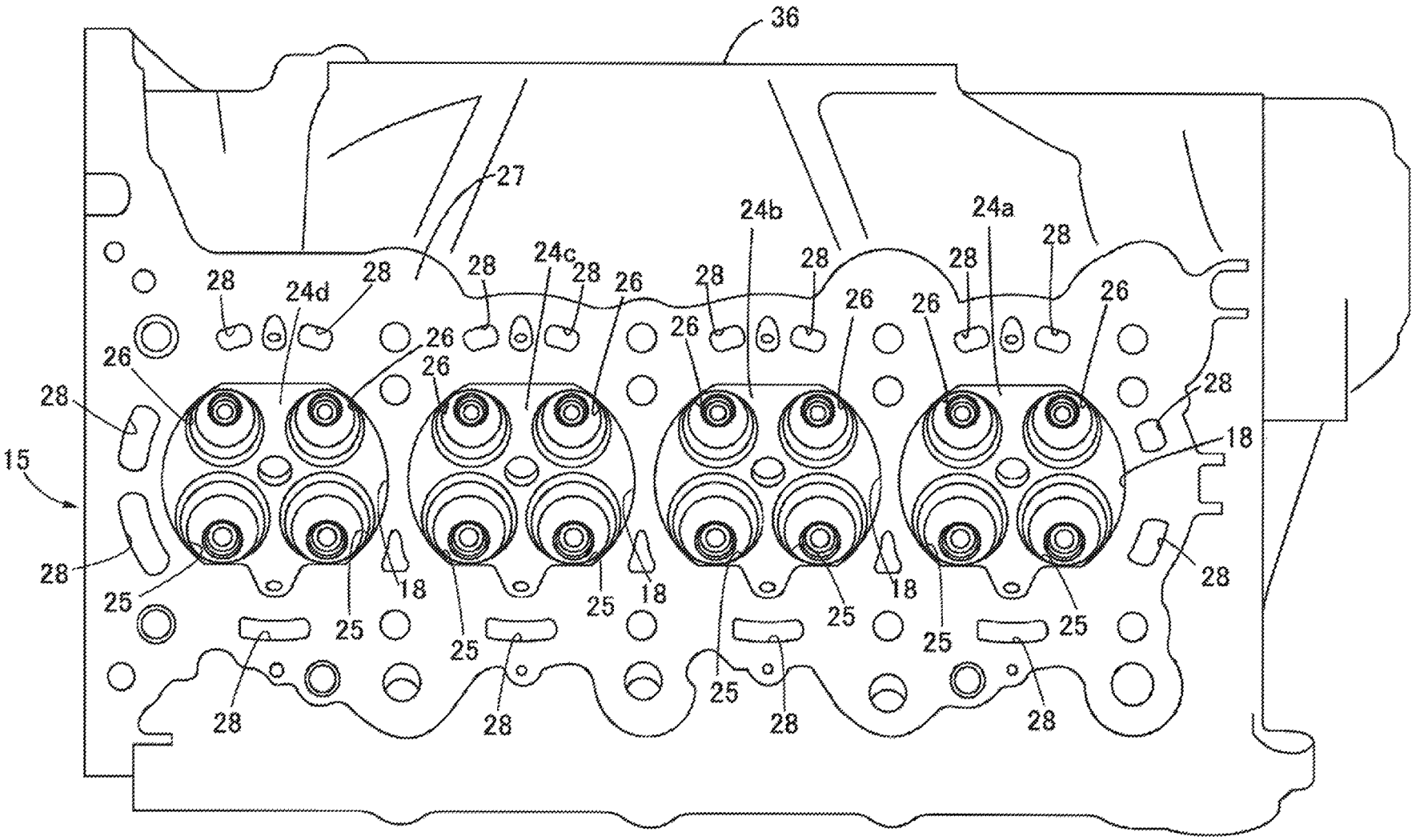
FIG. 2 is a bottom view of a cylinder head as viewed from a joining surface for a cylinder block.

As shown in FIG. 2, the cylinder head 15 is formed with a first ceiling surface 24*a* that closes the first cylinder bore, a second ceiling surface 24*b* that closes the second cylinder bore, a third ceiling surface 24*c* that closes the third cylinder bore, and a fourth ceiling surface 24*d* that closes the fourth cylinder bore. The first, second, third, and fourth ceiling surfaces 24*a* to 24*d* are respectively formed with two port openings 25 which are open side by side to the combustion chamber 18 and are connected to an intake port described later, and two port openings 26 which are open side by side to the combustion chamber 18 and are connected to an exhaust port described later. The cylinder head 15 is cast and molded from a metal material such as an aluminum alloy.

The cylinder head 15 is formed with a joining surface 27 that is liquid-tightly stacked on the cylinder block 13 around the first, second, third, and fourth ceiling surfaces 24*a* to 24*d*. On the joining surface 27, water jackets 28 connected to the water jackets (not shown) of the cylinder block 13 are opened around the first, second, third, and fourth ceiling surfaces 24*a* to 24*d*. The cylinder head 15 has a wall thickness for forming the water jackets 28 around the first, second, third, and fourth ceiling surfaces 24*a* to 24*d*. The spread of the joining surface 27 reflects the wall thickness around the first, second, third, and fourth ceiling surfaces 24*a* to 24*d*.

As shown in FIG. 1, the cylinder head 15 is formed with an intake port 31 connected to the combustion chamber 18 at each port opening 25, and an exhaust port 32 connected to the combustion chamber 18 at each port opening 26. Valve seats 33 are fixed to the port openings 25 of the intake port 31 and the port openings 26 of the exhaust port 32, respectively. The valve operating mechanism 14 includes an intake valve 34 that is supported by the cylinder head 15 to be displaceable in the axial direction and faces the combustion chamber 18 to open and close the intake port 31, and an exhaust valve 35 that is supported by the cylinder head 15 to be displaceable in the axial direction and faces the combustion chamber 18 to open and close the exhaust port 32. The intake valve 34 and the exhaust valve 35 are respectively seated on the valve seats 33 when the intake port 31 and the exhaust port 32 are closed.

The valve operating mechanism 14 causes the intake valve 34 and the exhaust valve 35 to displace in the axial direction by the action of a camshaft (not shown) that is supported by the cylinder head 15 to be rotatable around an axial center parallel to the rotation axis Rx of the crankshaft 21. A rocker arm (not shown) can be interposed between the intake valve 34 and the exhaust valve 35 and the camshaft when the intake valve 34 and the exhaust valve 35 are displaced in the axial direction.

Figure 3:
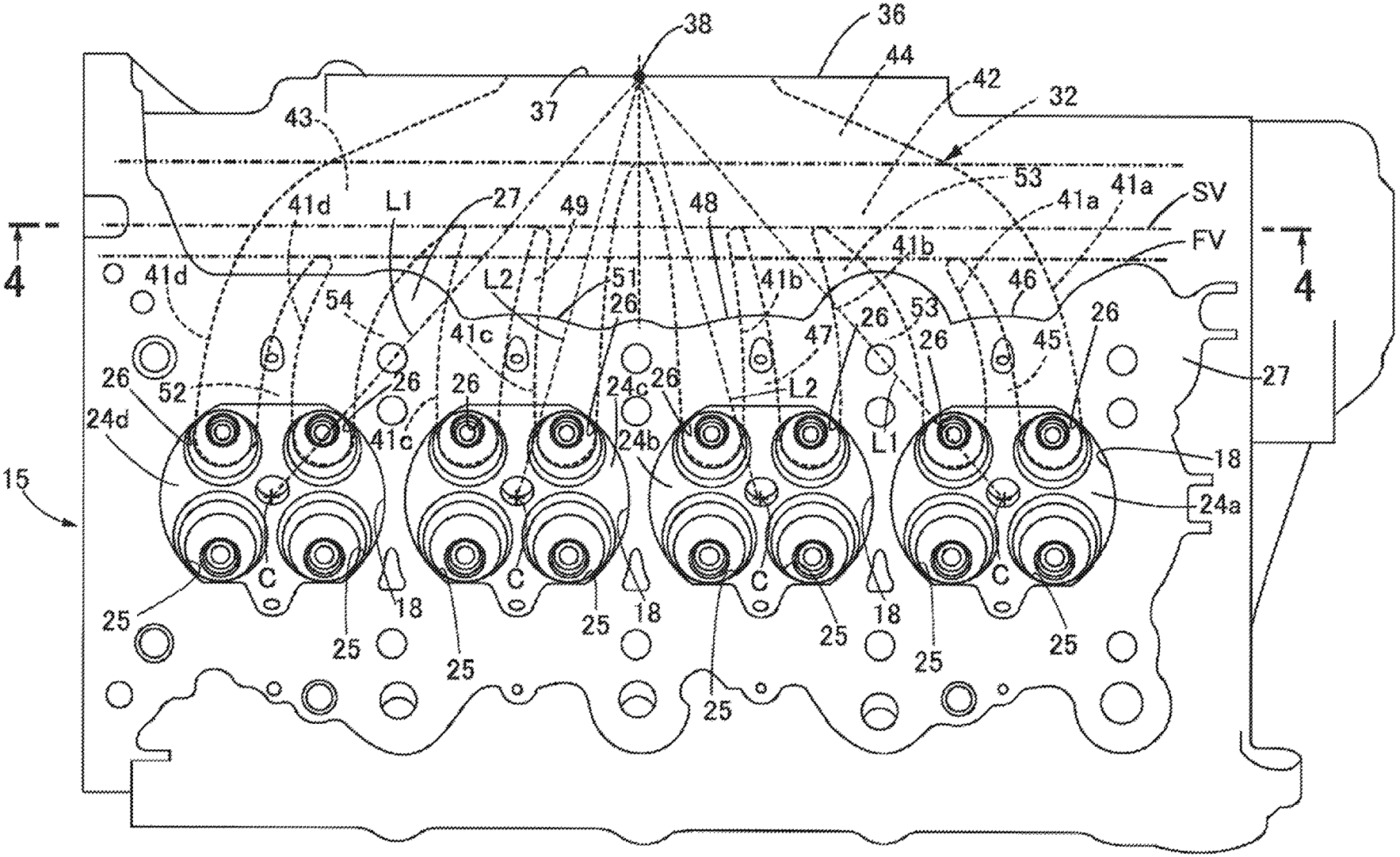
FIG. 3 is a conceptual diagram showing a positional relationship between exhaust ports in the cylinder head and the joining surface corresponding to FIG. 2.
Figure 4:
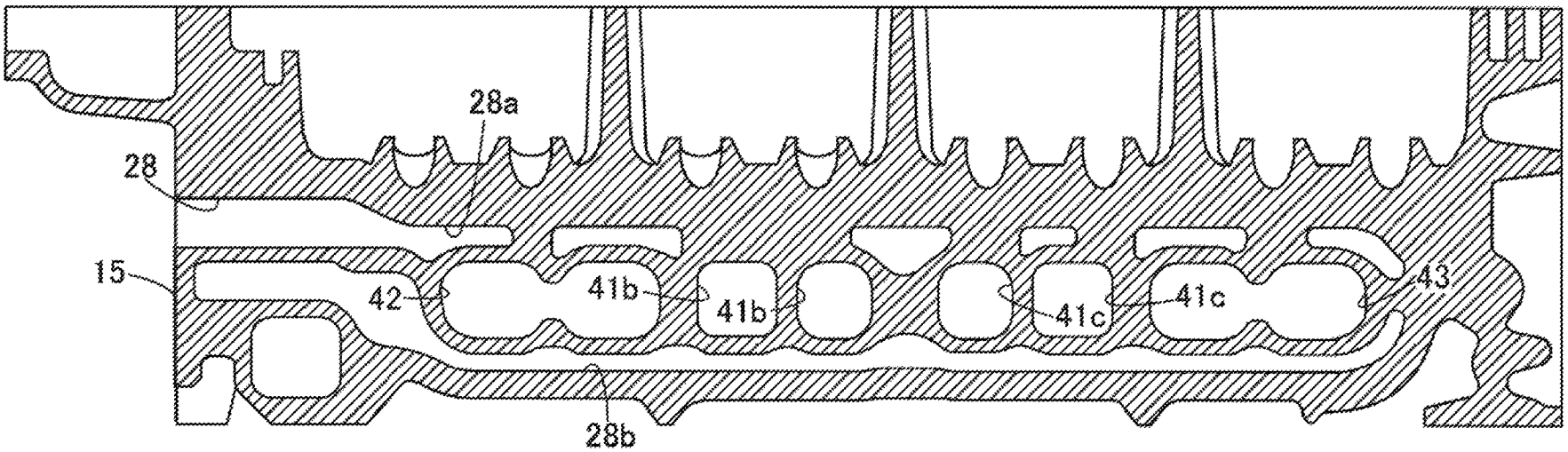
FIG. 4 is a cross-sectional view taken along the line 4-4 of FIG. 3.

As shown in FIG. 3 and FIG. 4, the exhaust port 32 has an exhaust opening 37 that is open on a coupling surface 36 parallel to the virtual plane including the cylinder axes C of the four cylinder bores 12. An exhaust pipe unit (not shown)

is coupled to the coupling surface 36. The first cylinder bore closed by the first ceiling surface 24*a* has a cylinder axis C separated from the exhaust opening 37 by a first distance L1. The second cylinder bore closed by the second ceiling surface 24*b* has a cylinder axis C separated from the exhaust opening 37 by a second distance L2 that is shorter than the first distance L1. The starting point of the distance is set at a bisector 38 that bisects the exhaust opening 37 within the coupling surface 36. Here, the third cylinder bore closed by the third ceiling surface 24*c* has a cylinder axis C separated from the exhaust opening 37 by the second distance L2, similarly to the second cylinder bore. The fourth cylinder bore closed by the fourth ceiling surface 24*d* has a cylinder axis C separated from the exhaust opening 37 by the first distance L1, similarly to the first cylinder bore.

The exhaust port 32 includes first individual ports 41*a* that individually extend from the port openings 26 of the first cylinder bores toward the exhaust opening 37, second individual ports 41*b* that individually extend from the port openings 26 of the second cylinder bores toward the exhaust opening 37, a first confluence port 42 that is connected to the first individual ports 41*a* and the second individual ports 41*b* to merge the first individual ports 41*a* and the second individual ports 41*b* into one and gradually shrinks toward the exhaust opening 37, third individual ports 41*c* that individually extend from the port openings 26 of the third cylinder bores toward the exhaust opening 37, fourth individual ports 41*d* that individually extend from the port openings 26 of the fourth cylinder bores toward the exhaust opening 37, a second confluence port 43 that is connected to the third individual ports 41*c* and the fourth individual ports 41*d* to merge the third individual ports 41*c* and the fourth individual ports 41*d* into one and gradually shrinks toward the exhaust opening 37, and a collecting port 44 that merges the first confluence port 42 and the second confluence port 43 into one and connects them to the exhaust opening 37. The first individual ports 41*a* merge outside the joining surface 27 of the cylinder head 15 for the cylinder block 13 in the plan view. That is, a first wall 45 that partitions the first individual ports 41*a* has a mother line parallel to the cylinder axis C and extends outward from the virtual surface 46 that is in contact with the contour of the joining surface 27. The second individual ports 41*b* merge outside the joining surface 27 of the cylinder head 15 for the cylinder block 13 in the plan view. That is, a second wall 47 that partitions the second individual ports 41*b* has a mother line parallel to the cylinder axis C and extends outward from the virtual plane 48 that is in contact with the contour of the joining surface 27. Since the third cylinder bore has a cylinder axis C separated from the exhaust opening 37 by the second distance L2, similarly to the second cylinder bore, a third wall 49 that partitions the third individual ports 41*c* extends with the same length as the second wall 47. Here, the third individual ports 41*c* merge outside the joining surface 27 of the cylinder head 15 for the cylinder block 13 in the plan view. That is, the third wall 49 has a mother line parallel to the cylinder axis C and extends outward from the virtual plane 51 that is in contact with the contour of the joining surface 27. Since the fourth cylinder bore has a cylinder axis C separated from the exhaust opening 37 by the first distance L1, similarly to the first cylinder bore, a fourth wall 52 that partitions the fourth individual ports 41*d* extends with the same length as the first wall 45. Here, the fourth individual ports 41*d* merge outside the joining surface 27 of the cylinder head 15 for the cylinder block 13 in the plan view.

The second wall 47 extends toward the side of the exhaust opening 37 with respect to the virtual plane FV that is parallel to the virtual plane including the cylinder axes C of the first, second, third, and fourth cylinder bores and is in contact with the tip of the first wall 45. Similarly, the third wall 49 extends toward the side of the exhaust opening 37 with respect to the virtual plane FV that is parallel to the virtual plane including the cylinder axes C of the first, second, third, and fourth cylinder bores and is in contact with the tip of the fourth wall 52.

The second wall 47 extends to the virtual plane SV that is parallel to the virtual plane including the cylinder axes C of the first, second, third, and fourth cylinder bores and is in contact with the tip of a wall 53 that partitions the first individual ports 41*a* of the first cylinder bore and the second individual ports 41*b* of the second cylinder bore. However, the second wall 47 may extend toward the side of the exhaust opening 37 with respect to the virtual plane SV. Similarly, the third wall 49 extends to the virtual plane SV that is parallel to the virtual plane including the cylinder axes C of the first, second, third, and fourth cylinder bores and is in contact with the tip of a wall 54 that partitions the fourth individual ports 41*d* of the fourth cylinder bore and the third individual ports 41*c* of the third cylinder bore. However, the third wall 49 may extend toward the side of the exhaust opening 37 with respect to the virtual plane SV.

As shown in FIG. 4, the water jacket 28 in the cylinder head 15 includes a first flow path 28*a* for circulating cooling water into the cylinder head 15 on the upper side of the exhaust port 32, and a second flow path 28*b* for circulating cooling water into the cylinder head 15 on the lower side of the exhaust port 32. The cooling water is supplied to the water jacket 28 from, for example, a water pump (not shown). The cooling water flows out from the water jacket 28 to, for example, a radiator. The heat of the exhaust gas in the exhaust port 32 is transferred to the metal body of the cylinder head 15, and is transferred from the metal body to the cooling water.

Figure 5:
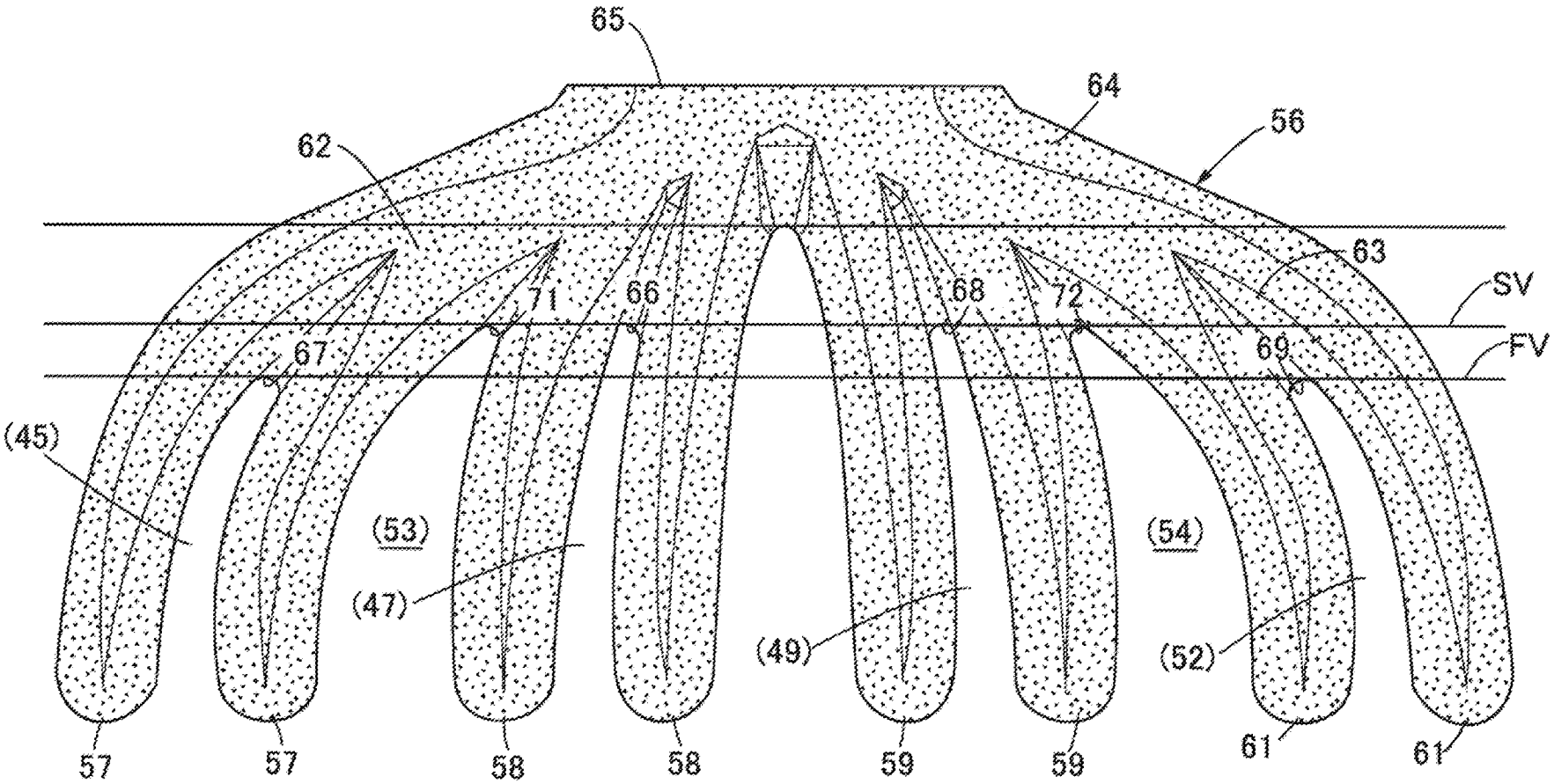
FIG. 5 is a plan view showing a core used for forming the exhaust port when casting the cylinder head.

FIG. 5 shows a core 56 for the exhaust port 32 used when casting the cylinder head 15. The core 56 includes a first pipe forming portion 57 that partitions spaces inside the metal body of the cylinder head 15 when forming the first individual ports 41*a*, a second pipe forming portion 58 that partitions spaces inside the metal body of the cylinder head 15 when forming the second individual ports 41*b*, a third pipe forming portion 59 that partitions spaces inside the metal body of the cylinder head 15 when forming the third individual ports 41*c*, and a fourth pipe forming portion 61 that partitions spaces inside the metal body of the cylinder head 15 when forming the fourth individual ports 41*d*. The first pipe forming portion 57, the second pipe forming portion 58, the third pipe forming portion 59, and the fourth pipe forming portion 61 are respectively formed in a rod shape extending while being curved.

The core 56 includes a first mass portion 62 that partitions a space inside the metal body of the cylinder head 15 when forming the first confluence port 42, a second mass portion 63 that partitions a space inside the metal body of the cylinder head 15 when forming the second confluence port 43, and a third mass portion 64 that partitions a space inside the metal body of the cylinder head 15 when forming the collecting port 44. The first pipe forming portion 57 and the second pipe forming portion 58 merge with the first mass portion 62. The third pipe forming portion 59 and the fourth pipe forming portion 61 merge with the second mass portion 63. The first mass portion 62 and the second mass portion 63 merge with the third mass portion 64. An end surface 65 that is fitted to the coupling surface 36 of the cylinder head 15 is partitioned in the third mass portion 64. The end surface 65 partitions the exhaust opening 37 on the coupling surface 36 of the cylinder head 15.

The first wall 45 is established with the metal body between the first pipe forming portions 57. The second wall 47 is established with the metal body between the second pipe forming portions 58. The third wall 49 is established with the metal body between the third pipe forming portions 59. The fourth wall 52 is established with the metal body between the fourth pipe forming portions 61. The wall 53 is established with the metal body between the adjacent first pipe forming portion 57 and second pipe forming portion 58. The wall 54 is established with the metal body between the adjacent third pipe forming portion 59 and fourth pipe forming portion 61.

The confluence position 66 between the second pipe forming portions 58 is on the side of the end surface 65 with respect to the virtual plane FV that is parallel to the virtual plane including the cylinder axes C of the first, second, third, and fourth cylinder bores and is in contact with the confluence position 67 between the first pipe forming portions 57. The confluence position 68 between the third pipe forming portions 59 is on the side of the end surface 65 with respect to the virtual plane FV that is parallel to the virtual plane including the cylinder axes C of the first, second, third, and fourth cylinder bores and is in contact with the confluence position 69 between the fourth pipe forming portions 61.

The confluence position 66 between the second pipe forming portions 58 is in the virtual plane SV that is parallel to the virtual plane including the cylinder axes C of the first, second, third, and fourth cylinder bores and is in contact with the confluence position 71 between the adjacent first pipe forming portion 57 and second pipe forming portion 58. The confluence position 68 between the third pipe forming portions 59 is in the virtual plane SV that is parallel to the virtual plane including the cylinder axes C of the first, second, third, and fourth cylinder bores and is in contact with the confluence position 72 between the adjacent third pipe forming portion 59 and fourth pipe forming portion 61. However, similarly to the second wall 47 and the third wall 49 described above, the confluence positions 66 and 68 may be on the side of the end surface 65 with respect to the virtual plane SV.

In the cylinder head 15 according to the present embodiment, two individual ports 41*a*, 41*b*, 41*c*, 41*d* for each cylinder extend individually from the combustion chamber 18. The two exhaust ports 41*a*, 41*b*, 41*c*, 41*d* for each cylinder merge with each cylinder outside the joining surface 27 of the cylinder head 15 for the cylinder block 13. The surface area of the exhaust port 32 in contact with the exhaust gas increases. Since heat is transferred from the exhaust gas in the exhaust port 32 to the metal body of the cylinder head 15, the exhaust gas can be effectively cooled corresponding to the increase of the surface area.

In the exhaust port 32, as the passage length from the port opening 26 to the exhaust opening 37 increases, the surface area in contact with the exhaust gas increases and the cooling effect for the exhaust gas improves. The surface area in contact with the exhaust gas decreases each time the exhaust port 32 merges. The cooling effect is weakened. Since the passage length from the port openings 26 corresponding to the outer first cylinder bore and fourth cylinder bore among the four cylinder bores in series to the exhaust opening 37 is longer than the passage length from the port openings 26 corresponding to the inner second cylinder bore and third cylinder bore to the exhaust opening 37, if the second wall 47 and the third wall 49 that partition the individual ports 41*b* and 41*c* corresponding to the second cylinder bore and the third cylinder bore are longer than the first wall 45 and the fourth wall 52 that partition the individual ports 41*a* and 41*d* corresponding to the first cylinder bore and the fourth cylinder bore, the cooling effect can be balanced at the exhaust ports 41*a* and 41*d* corresponding to the first and fourth cylinder bores and the exhaust ports 41*b* and 41*c* corresponding to the second and third cylinder bores. The variation in exhaust temperature between the cylinders can be reduced. By converging the exhaust temperature to a specific temperature, thermal deterioration of the catalyst can be prevented. The exhaust gas can be cooled properly.

In the present embodiment, the second wall 47 and the third wall 49 that partition the individual ports 41*b* and 41*c* corresponding to the inner second cylinder bore and third cylinder bore among the four cylinder bores in series extend to the virtual plane SV that is parallel to the virtual plane including the cylinder axes C of the first, second, third, and fourth cylinder bores and is in contact with the tips of the wall 53 that partitions the adjacent first individual port 41*a* and second individual port 41*b* and the wall 54 that partitions the adjacent third individual port 41*c* and fourth individual port 41*d*. By adjusting the lengths of the walls 53 and 54 in this way, the cooling effect of the exhaust port 32 corresponding to the inner second cylinder bore and third cylinder bore among the four cylinder bores in series can be balanced with the cooling effect of the exhaust port 32 corresponding to the outer first cylinder bore and fourth cylinder bore. The variation in exhaust temperature between the cylinders can be reduced. By converging the exhaust temperature to a specific temperature, thermal deterioration of the catalyst can be prevented. The exhaust gas can be cooled properly. In order to balance the cooling effect, the second wall 47 and the third wall 49 may extend to the exhaust opening 37 with respect to the virtual plane SV.

What is claimed is:

1. A multi-cylinder internal combustion engine (11), comprising a cylinder head (15) which comprises:

a first ceiling surface (24*a*) that closes a first cylinder having a cylinder axis (C) separated from an exhaust opening (37) by a first distance (L1);

a second ceiling surface (24*b*) that closes a second cylinder having a cylinder axis (C) separated from the exhaust opening (37) by a second distance (L2) shorter than the first distance (L1); and an exhaust port (32) that extends toward the exhaust opening (37) from wo port openings (26) which are open to a combustion chamber (18) for each individual cylinder, wherein the exhaust port (32) individually extends from each of the port openings (26) and merges with each cylinder outside a joining surface (27) of the cylinder head (15) for a cylinder block (13) in a plan view;

wherein a first wall (45) is provided to partition two exhaust ports (41*a*) in the first cylinder, a second wall (47) is provided to partition two exhaust ports (41*b*) in the second cylinder, and the second wall (47) is longer than the first wall (45).

2. The multi-cylinder internal combustion engine according to claim 1, wherein the second wall (47) that partitions the two exhaust ports (41*b*) in the second cylinder extends toward an exhaust opening (37) side with respect to a virtual plane (FV) that is parallel to a virtual plane including the cylinder axis (C) of the first cylinder and the cylinder axis (C)

of the second cylinder and is in contact with a tip of the first wall (45) that partitions the two exhaust ports (41*a*) in the first cylinder.

3. The multi-cylinder internal combustion engine according to claim 1, wherein the second wall (47) that partitions the two exhaust ports (41*b*) in the second cylinder extends to a virtual plane (SV) that is parallel to a virtual plane including the cylinder axis (C) of the first cylinder and the cylinder axis (C) of the second cylinder and is in contact with a tip of a wall (53) that partitions the exhaust ports (41*a*) of the first cylinder and the exhaust ports (41*b*) of the second cylinder, or extends toward the exhaust opening (37) side with respect to the virtual plane (SV).

4. The multi-cylinder internal combustion engine according to claim 2, wherein the second wall (47) that partitions the two exhaust ports (41*b*) in the second cylinder extends to a virtual plane (SV) that is parallel to the virtual plane including the cylinder axis (C) of the first cylinder and the cylinder axis (C) of the second cylinder and is in contact with a tip of a wall (53) that partitions the exhaust ports (41*a*) of the first cylinder and the exhaust ports (41*b*) of the second cylinder, or extends toward the exhaust opening (37) side with respect to the virtual plane (SV).

* * * * *